United States Patent [19]

Cooper

[11] 3,989,254

[45] Nov. 2, 1976

[54] BATTLE BOARD GAME APPARATUS

[75] Inventor: Julius Cooper, New Hyde Park, N.Y.

[73] Assignee: Ideal Toy Corporation, Hollis, N.Y.

[22] Filed: Oct. 9, 1975

[21] Appl. No.: 620,992

[52] U.S. Cl. ..... 273/131 B; 273/130 D; 273/1 R

[51] Int. Cl.[2] ..... A63F 3/00

[58] Field of Search ..... 273/1, 130, 131, 134

[56] References Cited

UNITED STATES PATENTS

| | | | |
|---|---|---|---|
| 1,232,133 | 7/1917 | Warden | 273/131 A |
| 1,295,436 | 2/1919 | Cogswell | 273/131 BA |

FOREIGN PATENTS OR APPLICATIONS

| | | | |
|---|---|---|---|
| 6,618,458 | 7/1967 | Netherlands | 273/131 BA |

*Primary Examiner*—Delbert B. Lowe
*Attorney, Agent, or Firm*—Richard M. Rabkin

[57] ABSTRACT

The battle simulating game includes a play board and two groups of play pieces, such as simulated tanks, which are releasably secured to a movement control member or slide plate so that they all move simultaneously in a given direction, selected in accordance with the rules of the game, in simulated tank attacks. Structure is provided for selectively indicating a "hit" on the tanks at predetermined locations along the board surface, with this location being different for each tank. Under the rules of the game the groups of tanks are moved back and forth along the play board's surface; and when a tank reaches its associated "hit" location it is moved by the indicating structure to indicate that it has been "blown up"; it is then removed from the game, with the winner being the player having the most tanks remaining at the end of the game.

21 Claims, 5 Drawing Figures

BATTLE BOARD GAME APPARATUS

The present invention relates to a battle simulating game and more particularly to a game in which play pieces, such as simulated army tanks, are moved along a play surface in an apparently random pattern according to the rules of the game, and seletively removed from the game when they reach predetermined locations along the play surface.

It is an object of the present invention to provide a game which enables the players to simulate a battle, and in particular a tank battle.

Another object of the present invention is to provide a battle simulating game which is relatively simple and inexpensive in construction.

A further object of the present invention is to provide a battle simulating game which is simple to operate, and has fairly simple rules which provide a relatively random movement for the play pieces during the play of the game.

A still further object of the present invetion is to provide a battle simulating game which is durable in construction and economical to manufacture.

The battle simulating game of the present invention includes a play board on which a simulated battlefield is duplicated. A play piece control member, e.g., a slide plate, is slidably mounted on the play board for movement between the opposite ends of the board. Two groups of pieces, such as for example simulated tanks, are removably secured to the slide plate so that they are laterally disaligned and each tank is associated with a "hit" area, i.e., a simulated mine hole or shell crater at which means are provided for moving the tank with respect to the slide plate to indicate that it has been hit by its opponent.

Under the rules of the game, as described more fully hereinafter, the slide plate is moved along the play surface a predetermined number of increments in simulated tank "attacks". Ultimately the tanks will move over the hit areas or simulated mine craters where they are moved by selectively operated means to indicate that the tanks have been "hit"; whereupon they are removed from the game. In one form of the game the winner is the player having the most tanks remaining when the game is over.

The above and other objects, features and advantages of the present invention will be apparent in the following detailed description of an illustrative embodiment thereof which is to be read in connection with the accompanying drawings, wherein.

Figure 1:
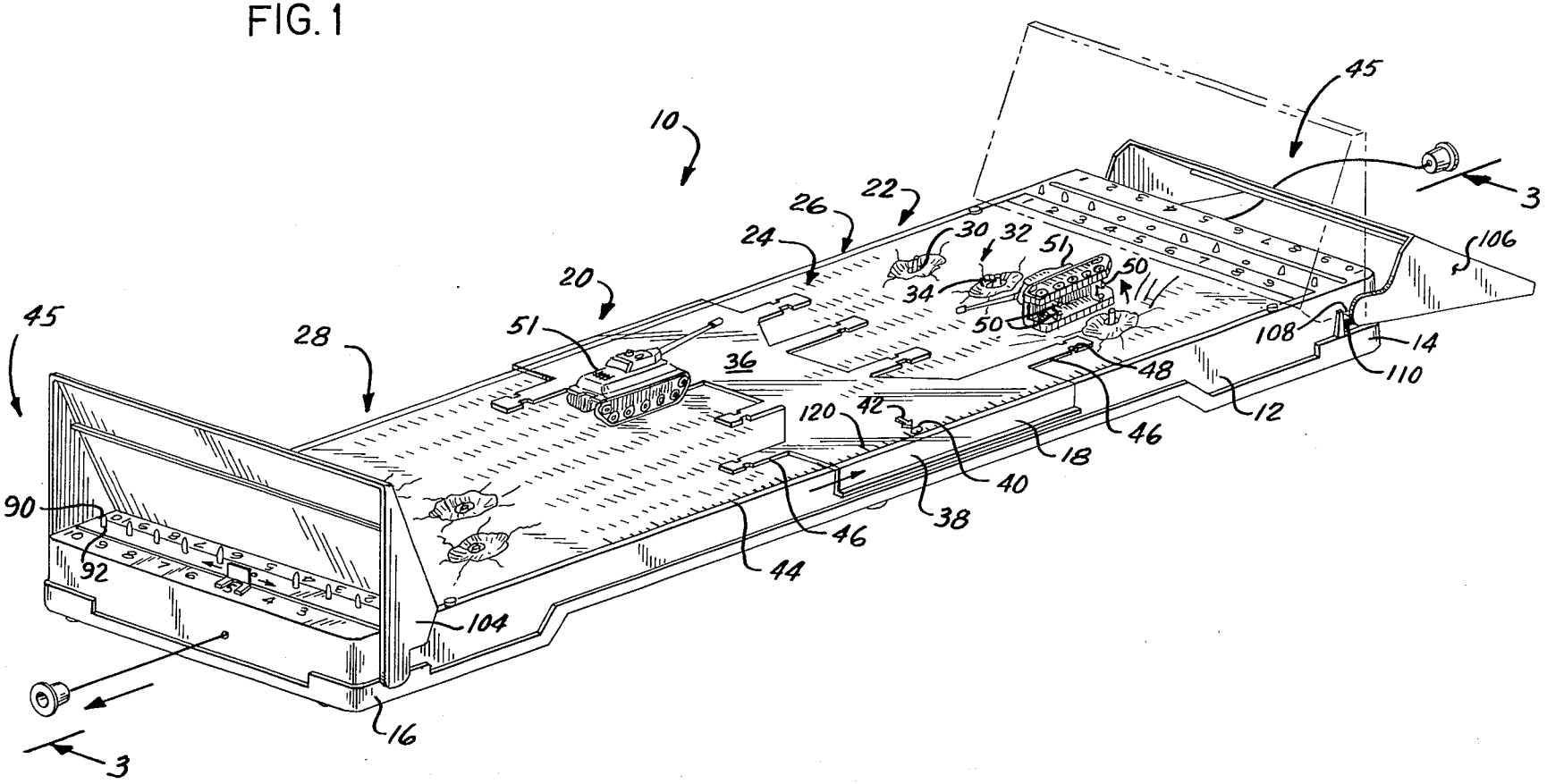
FIG. 1 is a perspective view of a battle simulating game constructed in accordance with the present invention.

Referring now to the drawing in detail, and initially to FIG. 1 thereof, a battle simulating game 10 is illustrated which consists of a molded plastic play board 12 having a pair of opposed ends 14, 16. A transparent slide plate 18 is slidably arranged on the play board 12 for longitudinal sliding movement therealong. This plate controls movement of two sets of play pieces 20, 22, as described hereinafter, to move the play pieces therewith during play of the game. It is noted that for illustrative purposes only two tanks are shown in FIG. 1 on opposite sides of the slide plate; however at the beginning of the game four tanks are provided in each group 20, 22 and are engaged with the slide plate in the manner described hereinafter.

Play board 12 includes a play surface 24 on which a simulated battlefield is provided. This battlefield can be applied to the play board 12 as a printed sheet of paper adhesively secured thereto or, alternatively, the battlefield can be molded into the play board itself. In any case, surface 24 is provided with two groups of tank "hit" areas or mine fields 26, 28, with an individual "hit" area or mine crater associated with each of the tanks. These areas each include an opening 30 formed therein, at which indicating means 32, selectively operated by the players, are located for indicating that the tanks have been "hit" by their opponent so as to be removed from the slide plate.

In the play of the game the tanks are moved towards the ends of the play board 12 so that they ultimately move over the mine fields 26, 28. Because of the lateral disalignment of the tanks in each group they enter their associated mine field sequentially rather than simultaneously. When a tank is moved into position over its associated mine crater, the indicating means 32 can be activated in order to raise a projection 34 on the indicating means to move or joggle the tank with respect to plate 18 (or even possibly disengage the tank from the slide plate 18) thereby to indicate that the tank has been "hit". The tank is then removed from the game.

Slide plate 18 consists of a generally U-shaped transparent plastic member having a central portion 36 and a pair of downwardly extending side flanges 38. The plate may have an aperture 40 and an arrow 42 molded therein for cooperation with a series of space marks 44 along the edge of battlefield 24. These marks serve as counters for the players during the incremental movements or spaces which plate 18 is moved during the simulated tank "attacks" which occur during the game. The number of spaces the plate is moved is determined by selection arrangements 45 controlled by the players.

Plate 18 also includes a plurality of longitudinally extending fingers 46 formed integrally therewith. These fingers serve to engage the tanks on opposite sides of the plate. The fingers are formed in different lengths so that the tanks are held in the desired laterally disaligned configuration.

In order to removably secure the individual tanks to the respective fingers 46, the ends of the fingers are provided with notches 48 formed on each of their longitudinally extending sides. These notches cooperate with a pair of integrally formed posts 50 on the underside of the respective tanks. That is, by vertically positioning a tank over a finger 46 the posts 50 on the tank will be received in the notches 48 so that the tank 51 will be retained on the fingers. However, vertical upward movement of the tank is permitted, so that the tank can be moved and even disengaged from the fingers by the indicatig means 32, as described hereinafter. Moreover, because of the notch and post arrangement, the tanks will move over play surface 24 with slide plate 18. Thus, when plate 18 is moved one set of tanks will move in a forward direction and the other set of tanks will move in reverse, thereby simulating a tank assault by one group of tanks against the other in a mock battle.

Figure 2:
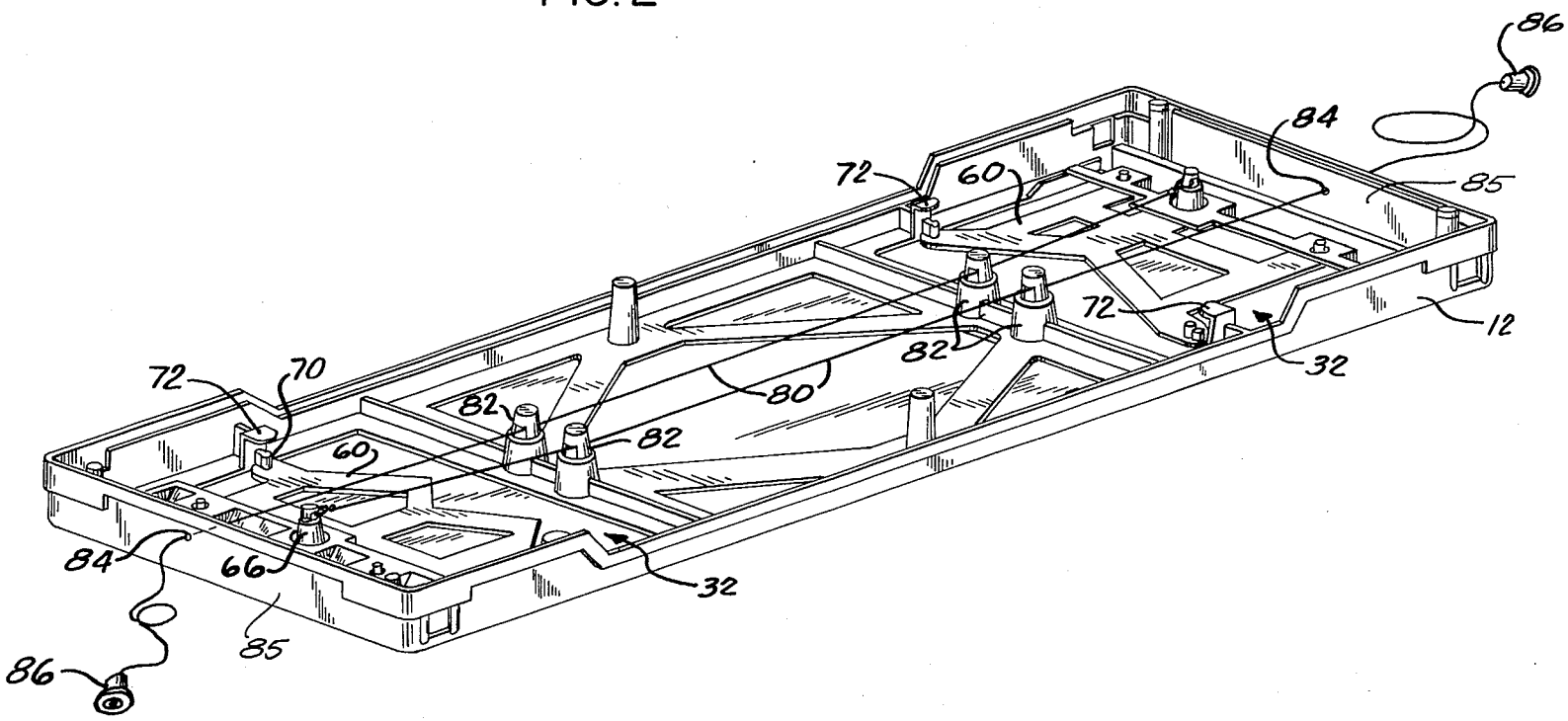
FIG. 2 is an inverted perspective view of the game illustrated in FIG. 1 (with parts removed) illustrating the play piece "hit" indicating mechanism.

The "hit" indicating mechanism used in the embodiment of the invention illustrated in the drawings, is seen in greater detail in FIGS. 2 and 3. As shown therein each of the "hit"areas or mine craters 26, 28 has a movable plate 60 respectively associated therewith on the lower side of the play board 12 directly below the battlefield or play surface 24. These plates are each vertically supported in the play board at one end by a support bar 62 which extends laterally across the play board below play surface 24. Bar 62 has an aperture 64 formed therein through which an operating post 66, integrally formed with plate 60, extends. The opposite end 68 of the plate 60 has support pins 70 integrally formed which rest on shoulders or flange members 72 extending laterally from the side walls of the play board, as seen most clearly in FIG. 2.

The upper surface 74 of plate 60 has the projections 34 formed integrally therewith; these projections are respectively located directly below the apertures 30 formed in the simulated mine craters. There is one projection associated with each of these apertures.

In order to move or joggle a tank with respect to plate 18, projections 34 are raised upwardly through the openings 30. It is noted that these openings are positioned such as to be in direct alignment with the simulated tank track or tread 78 on one side of each of the tanks, in the path of travel of the tank when secured to its associated finger 46 on plate 18. Thus, during the play of the game, when a tank moves over its associated mine crater 32, one of its tank tracks 78 will move into position directly above its associated opening 30 in the play surface.

A lanyard or pull cord 80 is secured to the projection 66 of each plate 60 in order to raise the projections 34 on the plate 60 through the openings 30. Each lanyard is threaded through openings in a pair of associated guide posts 82, and an opening 84 in one of the end walls 85 of play board 12. Knobs 86 or the like are secured to the ends of the lanyards to facilitate pulling by the players. Of course, each lanyard is seperately operated by the respective players.

Figure 3B:
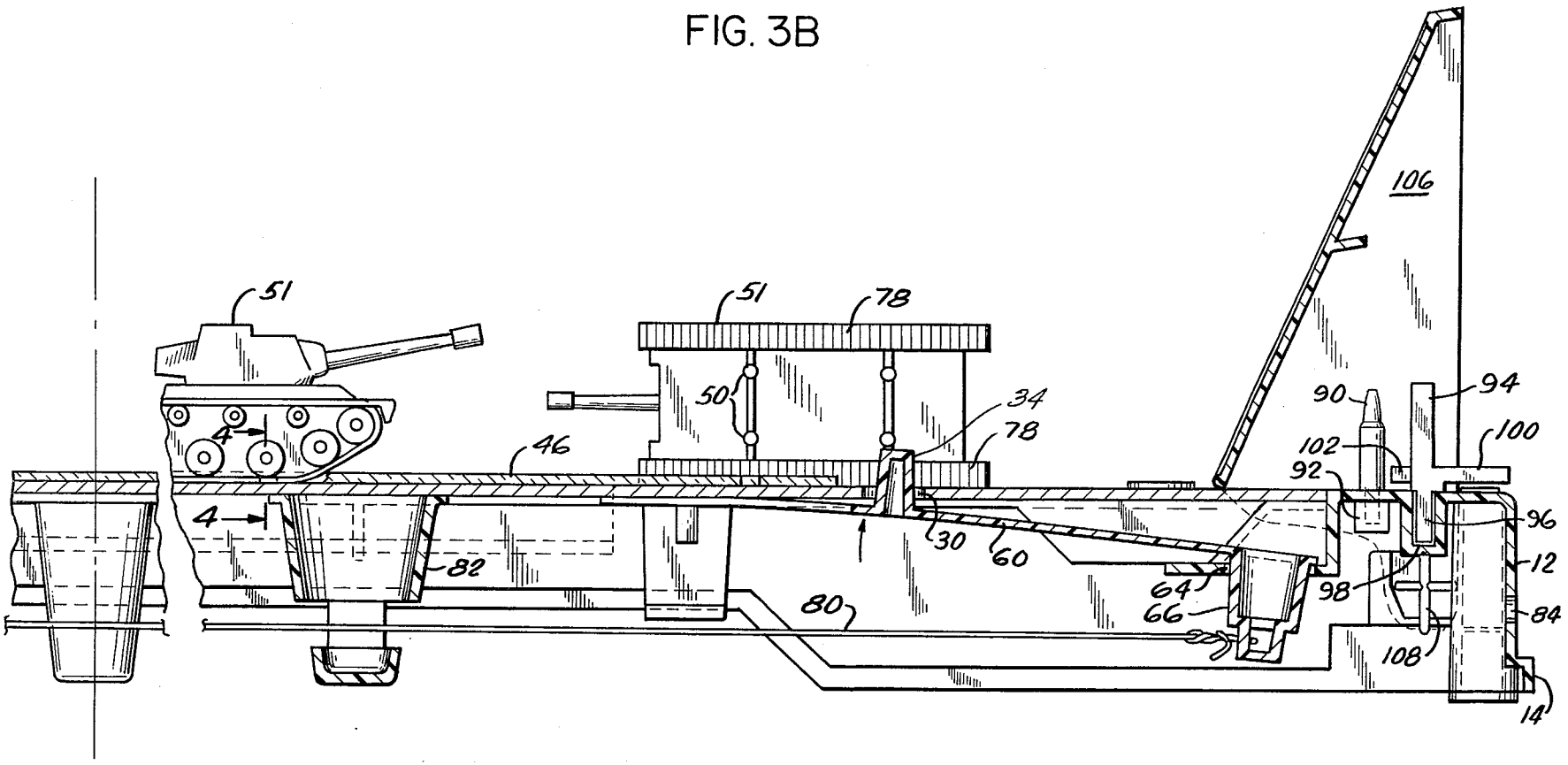
FIGS. 3A and 3B are a combined longitudinal sectional view taken along line 3—3 in FIG. 1.
Figure 4:
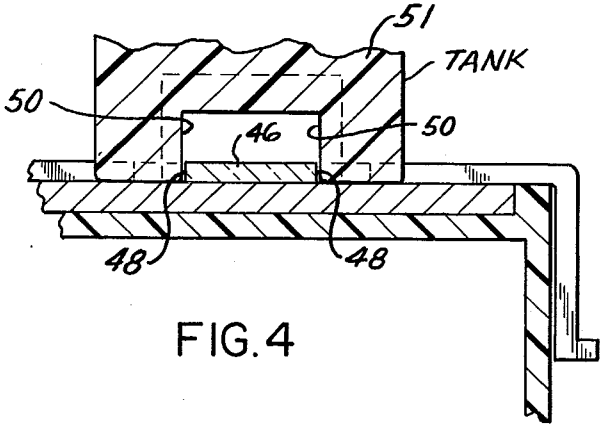
FIG. 4 is a sectional view taken along line 4—4 of FIG. 3B, showing the connection of the play piece to the slide plate.
Figure 3A:
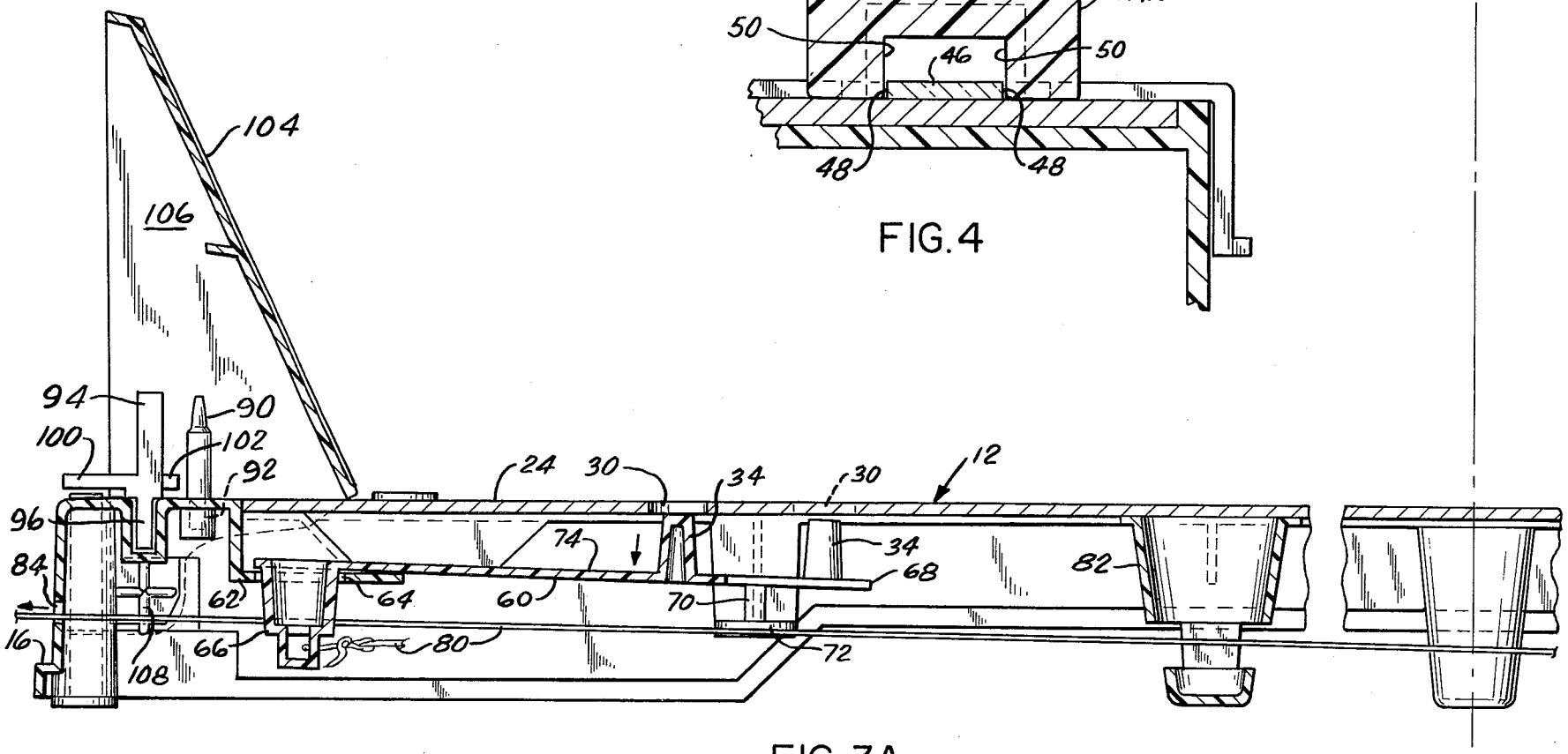

As seen in FIG. 3A, in the normal or at rest position of plate 60, the plate is supported on bar 62 and shoulders 72, with projections 34 located below play surface 24. When the lanyard secured to the plate is pulled, the plate pivots in opening 64, as illustrated in FIG. 3B, thereby causing its projections 34 to move through apertures 30. Should a tank track 78 be located directly above one of the apertures 30 in the group associated with the raised plate, the projection will engage the tank track and urge it upwardly, moving or tilting the tank with respect to plate 18 and possibly causing it to tilt over. This indicates that the tank is "hit"; it is then removed from the game whether it was actually tilted over or not. When the pull on the lanyard 80 is released, the plate 60 returns to its normal at rest position.

Movement of slide plate 18 can be controlled in accordance with any desired set of rules. For example a pair of dice can be provided with the game and alternately thrown by the players to determine the number of spaces the plate should be moved, with the players alternately throwing the dice and moving the plate in a direction towards the mine craters at their opponent's end of the play board. However, in a presently preferred embodiment of the invention, a novel and challenging selection arrangement 45 has been devised for determining the direction and number of spaces in which plate 18 shall be moved. In accordance therewith, each player has a separate selection arrangement 45 including a set of ten simulated tank shells 90, which are in the form of pegs (see FIG. 3). These shells are initially inserted in openings or pockets 92 formed in lateral alignment with each other along the ends 14, 16 of the play surface 24. In the illustrative embodiment of the invention 10 such pockets and shells are provided. In addition each pocket is identified by an appropriate numeral printed on the play surface with the battlefield.

A selection indicator slide indicator slide 94, consisting of a plate element (see FIG. 3B) having its lower end 96 slidably positioned in a longitudinal slot 98 formed in the play board 12, includes a manually engageable tab 100 which allows the player to slide the indicator in the slot. A pointer arrow 102 can be provided on the inner face of the plate 94 in order to indicate the shell selected.

As mentioned, each end of the play board is provided with a similar set of shells and a slide indicator 94. These shells and indicators are normally hidden from the view of a player's opponent by means of a panel element 104 that is pivotally mounted on play board 12 in any convenient manner. As illustrated in FIG. 1, each panel includes a pair of side legs 106 having pivot pins 108 received in openings 110 in the side wall of play board 12 to allow the panels to pivot from the upright dotted line position illustrated at the right in FIG. 1 to the solid line position thereof. In the upright position of the panel shells 90 and selector 94 are hidden from opponent's view.

In the play of the game panel 18 is initially centered on battlefield 24 by aligning arrow 42 with the center mark 120 in the group of space marks 44 along the side of the play board. Each of the tanks is then secured to the fingers 46, as previously described. Then, a player is selected to commence the first "attack" and panels 104 are placed in their upright or firing position. The two players select a shell or peg to fire by placing their indicator 94 adjacent that shell. Each shell has a "fire power" determined by the number associated therewith so that the higher the number the higher the "fire power" of the shell. Each player tries to select a shell which has a higher fire power than that selected by his opponent. After each player has a shell to fire, they lower their panels 104 to determine which player has selected the highest "fire power" shell. That player wins the "attack" and totals the number of his selected shell plus the number of his opponent's selected shell. He then moves slide plate 18 in the direction of his opponent a number of spaces equal to the total of the two shells. Thus all of the tanks will move in that direction.

For example, if one player selects a shell numbered 8 and the other player selects a shell number 6, the first player wins and moves the slide 18, from the center marking point 120, 14 spaces towards his opponent. Each mark on the side in the group 44 on the side of the battlefield represents one space.

The fired shells are removed from the game after each "attack" and the players then commence a second "attack" by raising panels 104 and selecting new shells in the same procedure as was followed in the first attack. It is noted that if both players select the same numbered shell a stand off is reached and the shells are removed from the game but the tanks are not moved.

These "attacks" or shell selections are repeated until all 10 shells are fired. During the course of this procedure one or more of the tanks will be moved into position over a mine crater associated therewith so that its tank tread 78 aligns with the aperture 30 in that shell crater. When a player's tank is moved into that position after an "attack" the player's opponent can pull his lanyard 80 to raise the plate 60 below the tank. The pin 34 associated with the tank will engage tread 78 and move the tank or even disengage it from the finger 46 to which it is secured. Movement of the tank and/or its disengagement from its finger 46 indicates a "hit" and the tank is removed from the game. It is noted that although the tanks themselves are staggered or laterally disaligned with each other, as are the land mines, it is possible that if plate 18 is moved a sufficient number of spaces more than one tank will be positioned over a land mine. In that case operation of plate 60 will cause more than one tank to move or even become disengaged from plate 18, so that more than one tank can possibly be removed from the game during a single "attack".

In the event that the number of spaces which plate 18 is to be moved during an attack is such that a tank would be moved past a mine crater, the player moving the plate can stop movement with the tank in position over the mine crater, operate plate 60, remove the tank from the game, and then continue moving the slide plate.

After all of the shells have been fired, the first tank "battle" is over. If both players have one or more tanks remaining on the battlefield, all of the shells are returned into the holes numbered 1–10 associated with each of the players, and a second "battle" is commenced continuing from the position at which the plate 18 was located at the end of the first "battle". The second "battle" continues in the same way until all of the tanks of one of the players are removed from the game. If, when all of the shells 90 are used during the second "battle", both players still have tanks remaining, the winner will be the player who has the most tanks. If both players have the same number of tanks, the winner is the player who has pushed his opponent's tank past the starting point marker 120. Alternatively, the players can continue playing the game (i.e. play a third, fourth "battle" etc.) until one of the players has all of his tanks removed from the game.

Accordingly, it will be appreciated that a relatively simply constructed game is provided which simulates the action of a tank battle, while providing a substantial degree of interest for the players. That is, the players must use a substantial degree of ingenuity and skill in trying to select shells that are higher than their opponent, without selecting shells that are so much higher than that selected by the opponent as to place the player at a disadvantage during following "attacks". Thus the players have a degree of control over the movement of the tanks and can plan a strategy in the successive attacks and battles during the course of the game.

Although an illustrative embodiment of the present invention has been described herein with reference to the accompanying drawings, it is to be appreciated that various changes and modifications can be effected therein by one skilled in the art without departing from the scope or spirit of this invention.

What is claimed is:

1. A battle game comprising a playing board, control means movably mounted on said playing board, a plurality of play pieces removably engaged with said control means for movement therewith along the playing board, and selectively operable indicating means for moving the play pieces with respect to the control means to indicate that the play piece is to be removed from the game.

2. A battle game as defined in claim 1 wherein said selectively operable indicating means comprises means respectively associated with each of said play pieces for engaging and moving the play pieces with respect to the control means at a different position of the control means on the playing board for each of said play pieces.

3. The battle game as defined in claim 1 wherein said playing board has at least two groups of play piece "hit" areas defined thereon with each area being respectively associated with one of the play pieces and a different position of said control means, and said indicating means comprises means at each of said "hit" areas for moving a play piece with respect to said control means when a portion of the play piece is over that area.

4. The battle game as defined in claim 3 wherein said playing board has an aperture therein located at each of said "hit" areas, and said indicating means comprises a plate means movably mounted in said game below each of said goups of "hit" areas and having a plurality of projections extending upwardly therefrom respectively associated with said apertures; and means for selectively moving said plates to simultaneously raise said projections thereon through their associated apertures whereby at least one of the projections can engage a play piece positioned in its associated "hit" area over the aperture therein.

5. The battle game as defined in claim 1 wherein said control means is a slide plate slidably mounted on said game board for movement therealong, said plate and play pieces having cooperating means for engaging said play pieces with said plate.

6. The battle game as defined in claim 5 wherein said plate has two groups of elongated flat tongues extending outwardly therefrom in opposite directions along the play board and parallel to the direction of sliding movement of the plate, with the tongues in each group being of varying lengths, said cooperating means being located on said tongues whereby the play pieces secured to each group of tongues are laterally disaligned with respect to the direction of sliding movement of the plate.

7. The battle game as defined in claim 6 wherein said cooperating means on said tongues and play pieces comprise at least one notch formed on each of said tongues and a cooperating post on the play piece received in said notch.

8. The battle game as defined in claim 1 including selectively operable means for determining the direction and amount of movement of the control means during play of the game.

9. The battle game as defined in claim 8 wherein said selectively operable means comprises two groups of a plurality of markers removably mounted on the game board and having numerical indicia of different values associated with the markers of a group; and means for a player to designate a marker selected.

10. The battle game as defined in claim 9 wherein said play board has a pair of opposed ends, said groups of markers are located at opposite ends of the play board; and means at said opposite ends for selectively concealing said markers and the means for a player to designate a marker selected.

11. A battle simulating game comprising a playing board having a play surface and a pair of opposed end portions, a slide plate slidably mounted on said play board between said opposed end portion, two groups of play pieces respectively removably engaged with said slide plate on opposite sides thereof for movement with the slide plate along said play surface, and selectively operable indicating means for moving individual play pieces with respect to said slide plate at different positions thereof, to indicate a "hit" on the play pieces.

12. A battle simulating game as defined in claim 11 wherein said slide plate includes means for removably securing the play pieces of each group thereto at laterally disaligned positions with respect to each other and to the direction of sliding movement of the plate.

13. A battle simulating game as defined in claim 12 wherein said playing surface has two groups of play piece "hit"areas defined thereon respectively located adjacent said opposite end portions of the play board, with each of said areas being respectively associated with one of said play pieces and a different position of said slide plate along the play board; said indicating means comprising means at each of said play areas for moving a play piece with respect to said slide plate when a portion of the play piece associated therewith is over a "hit"area.

14. The battle simulating game as defined in claim 13 wherein said playing board has an aperture therein located at each of said "hit" areas, and said indicating means comprises a plate means movably mounted in said game below each of said groups of "hit" areas and having a plurality of projections extending upwardly therefrom respectively associated with said apertures; and means for selectively moving said plate means to simultaneously raise said projections thereon through their associated apertures whereby at least one of the projections can engage a play piece positioned in its associated "hit" area, over the aperture, to move the play piece and indicate a "hit".

15. The battle simulating game as defined in claim 13 wherein said means for removably securing the play pieces to said slide plate comprise two groups of elongated flat tongues extending outwardly from said slide plate in opposite directions along the play surface towards the opposite ends of the play board, with each of the tongues in a group having a different length.

16. The battle simulating game as defined in claim 15 wherein said tongues and play pieces include cooperating means for engaging the play pieces to said plate.

17. The battle simulating game as defined in claim 16 wherein said cooperating means on said tongues and play pieces comprise at least one notch formed on each of said tongues and a cooperating post on the play piece received in said notch.

18. The battle simulating game as defined in claim 16 including selectively operable means for determining the direction and amount of movement of said slide plate during play of the game.

19. The battle simulating game as defined in claim 18 wherein said selectively operably means comprises two groups of a plurality of markers removably mounted on the game board and having numerical indicia of different value associated with the markers of a group; and means for a player to designate a marker selected.

20. The battle simulating game is defined in claim 19 wherein said groups of markers are located at opposite ends of the play board; and means are located at said opposite ends of the board for selectively concealing said markers and means for a player to designate a marker selected.

21. The battle simulating game as defined in claim 20 wherein the play pieces are simulated tanks.

* * * * *